US007945446B2

(12) United States Patent
Kemmochi et al.

(10) Patent No.: US 7,945,446 B2
(45) Date of Patent: May 17, 2011

(54) SOUND PROCESSING APPARATUS AND METHOD, AND PROGRAM THEREFOR

(75) Inventors: Hideki Kemmochi, Shizuoka (JP); Yasuo Yoshioka, Hamamatsu (JP); Jordi Bonada, Barcelona (ES)

(73) Assignee: Yamaha Corporation, Hamamatsu-shi (JP)

( * ) Notice: Subject to any disclaimer, the term of this patent is extended or adjusted under 35 U.S.C. 154(b) by 989 days.

(21) Appl. No.: 11/372,812

(22) Filed: Mar. 9, 2006

(65) Prior Publication Data

US 2006/0212298 A1 Sep. 21, 2006

(30) Foreign Application Priority Data

Mar. 10, 2005 (JP) ..... 2005-067907

(51) Int. Cl.
*G10L 21/00* (2006.01)
*G10L 13/06* (2006.01)
*G10L 13/00* (2006.01)

(52) U.S. Cl. ..... 704/278; 704/241; 704/265; 704/268; 704/264; 704/269

(58) Field of Classification Search ..... 704/278
See application file for complete search history.

(56) References Cited

U.S. PATENT DOCUMENTS

| | | | | |
|---|---|---|---|---|
| 5,056,150 | A * | 10/1991 | Yu et al. | 704/248 |
| 5,301,259 | A * | 4/1994 | Gibson et al. | 704/258 |
| 5,536,902 | A * | 7/1996 | Serra et al. | 84/623 |
| 5,567,901 | A * | 10/1996 | Gibson et al. | 84/603 |
| 5,749,073 | A * | 5/1998 | Slaney | 704/278 |
| 5,750,912 | A * | 5/1998 | Matsumoto | 84/609 |
| 5,933,808 | A * | 8/1999 | Kang et al. | 704/278 |
| 5,956,685 | A * | 9/1999 | Tenpaku et al. | 704/278 |
| 6,336,092 | B1 | 1/2002 | Gibson et al. | |
| 6,549,884 | B1 * | 4/2003 | Laroche et al. | 704/207 |
| 6,836,761 | B1 * | 12/2004 | Kawashima et al. | 704/258 |
| 6,925,116 | B2 * | 8/2005 | Liljeryd et al. | 375/240 |
| 7,283,955 | B2 * | 10/2007 | Liljeryd et al. | 704/219 |
| 2003/0016772 | A1 * | 1/2003 | Ekstrand | 375/350 |
| 2003/0221542 | A1 | 12/2003 | Kenmochi et al. | |
| 2006/0173676 | A1 * | 8/2006 | Kemmochi et al. | 704/207 |

FOREIGN PATENT DOCUMENTS

| | | |
|---|---|---|
| JP | 04-147300 A | 5/1992 |
| JP | 10-078776 | 3/1998 |

OTHER PUBLICATIONS

Kahlin, D. et al., "The Chorus Effect Revisited-Experiments in Frequency-Domain", IEEE, Sep. 8, 1999, vol. 2, pp. 75-80. Bonada, Jordi et al., "Spectral Approach to the Modeling of the Singing Voice", Audio Engineering Society Convention Paper, 11th Convention, Sep. 21-24, 2001, New York, NY, pp. 1-10.
Bonada, Jordi, "Voice Solo to Unison Choir Transformation", Audio Engineering Society Convention Paper 6362, 118th Convention, May 28-31, 2005, Barcelona, Spain.
Notice of Grounds for Rejection mailed Jul. 6, 2010, for JP Patent Application No. 2005-067907, with English Translation, four pages.

* cited by examiner

*Primary Examiner* — Richemond Dorvil
*Assistant Examiner* — Michael Ortiz Sanchez
(74) *Attorney, Agent, or Firm* — Morrison & Foerster LLP

(57) ABSTRACT

Spectrum envelope of an input sound is detected. In the meantime, a converting spectrum is acquired which is a frequency spectrum of a converting sound comprising a plurality of sounds, such as unison sounds. Output spectrum is generated by imparting the detected spectrum envelope of the input sound to the acquired converting spectrum. Sound signal is synthesized on the basis of the generated output spectrum. Further, a pitch of the input sound may be detected, and frequencies of peaks in the acquired converting spectrum may be varied in accordance with the detected pitch of the input sound. In this manner, the output spectrum can have the pitch and spectrum envelope of the input sound and spectrum frequency components of the converting sound comprising a plurality of sounds, and thus, unison sounds can be readily generated with simple arrangements.

16 Claims, 6 Drawing Sheets

SOUND PROCESSING APPARATUS AND METHOD, AND PROGRAM THEREFOR

BACKGROUND OF THE INVENTION

The present invention relates to techniques for varying characteristics of sounds.

So far, a variety of techniques have been proposed for imparting musical effects to sounds uttered or generated by users (hereinafter referred to as "input sounds"). For example, Japanese Patent Application Laid-open Publication No. HEI-10-78776 (in particular, see paragraph 0013 and FIG. 1 of the publication) discloses a technique in accordance with which a concord sound (i.e., sound forming a chord with an input sound), generated by converting the pitch of the input sound, is added with the input sound and outputs the result of the addition. Even where there is only one sound-uttering or sound-generating person, the arrangements disclosed in the No. HEI-10-78776 publication (hereinafter referred to as "patent literature") can generate sounds as if a plurality of persons were singing different melodies in ensemble. For example, if the input sound is a performance sound of a musical instrument, the disclosed arrangements can generate sounds as if different melodies were being performed in ensemble via a plurality of musical instruments.

There are known various forms of ensemble singing and ensemble musical instrument performance, among which are the so-called "chorus" where a plurality of singers or performers sing or perform different melodies and the so-called "unison" where a plurality of singers or performers each sing or perform a same or common melody. The arrangements disclosed in the above-identified patent literature, where a consonant sound is generated by converting the pitch of an input sound, can not impart an input sound with an effect of a "unison" where a plurality of singers or performers each sing or perform a same or common melody, although the disclosed arrangements can generate sounds with an effect of a "chorus" where a plurality of singers or performers sing or perform different melodies. Even with the arrangements disclosed in the above-identified patent literature, it would be possible to impart a unison effect, in a fashion, as though a plurality of singers or performers were each singing or performing a common melody, by outputting, along with the input sound, a sound created by converting only an acoustic characteristic (sound quality) of the input sound without changing the pitch of the input sound. In this case, however, it is essential to provide arrangements for converting the input sound characteristic per input sound constituting unison sounds. Thus, in cases where unison sounds by a plurality of persons are to be achieved, electric circuitry employed for converting the characteristic of each input sound by hardware, such as a DSP (Digital Signal Processor), would become great in size or scale. If the input sound characteristic conversion is performed by software, on the other hand, processing load on an arithmetic operation device would become excessive.

SUMMARY OF THE INVENTION

In view of the foregoing, it is an object of the present invention to provide a technique for converting, with a simple structure, an input sound into sounds of ensemble singing or ensemble musical instrument performance by a plurality of persons.

In order to accomplish the above-mentioned object, the present invention provides an improved sound processing apparatus, which comprises: an envelope detection section that detects a spectrum envelope of an input sound; a spectrum acquisition section that acquires a converting spectrum that is a frequency spectrum of a converting sound comprising a plurality of sounds; a spectrum conversion section that generates an output spectrum created by imparting the spectrum envelope of the input sound, detected by the envelope detection section, to the converting spectrum acquired by the spectrum acquisition section; and a sound synthesis section that synthesize a sound signal on the basis of the output spectrum generated by the spectrum conversion section.

The converting sound contains a plurality of sounds generated at the same time, such as unison sounds. According to the present invention, where the envelope of the converting spectrum of the converting sound is adjusted to substantially accord with the spectrum envelope of the input sound, there can be generated an output sound signal representative of a plurality of sounds (i.e., sounds of ensemble singing or ensemble musical instrument performance) which have similar phonemes to the input sound. Besides, according to the present invention, arrangements or construction to convert an input sound characteristic for each of a plurality of sounds are unnecessary in principle, and thus, the construction of the inventive sound processing apparatus can be greatly simplified as compared to the construction disclosed in the above-discussed patent literature. It should be appreciated that the term "sounds" as used in the context of the present invention embraces a variety of types of sounds, such as voices uttered by persons and performance sounds generated by musical instruments.

As an example, the sound processing apparatus of the present invention includes an envelope adjustment section that adjusts the spectrum envelope of the converting spectrum to substantially accord with the spectrum envelope of the input sound detected by the envelope detection section. In this case, the "substantial accordance" between the spectrum envelope of the input sound detected by the envelope detection section and the spectrum envelope of the converting spectrum means that, when a sound is actually audibly reproduced (i.e., sounded) on the basis of the output sound signal generated in accordance with the frequency spectrum adjusted by the envelope adjustment section, the two spectrum envelopes are approximate (ideally identical) to each other to the extent that the audibly reproduced sound can be perceived to be acoustically or auditorily identical with phoneme to the input sound. Thus, it is not necessarily essential that the spectrum envelope of the input sound and the spectrum envelope of the converting spectrum adjusted by the envelope adjustment section completely agree with each other in the strict sense of the word "agreement".

In the sound processing apparatus of the present invention, the output sound signal generated by the sound synthesis section is supplied to sounding equipment, such as a speaker or earphones, via which the output sound signal is output as an audible sound (hereinafter referred to as "output sound"). However, a specific form of use of the output sound signal may be chosen as desired. For example, the output sound signal may be first stored in a storage medium and then audibly reproduced as the output sound via another apparatus that reproduces the storage medium, or the output sound signal may be transmitted over a communication line to another apparatus and then audibly reproduced as a sound via the other apparatus.

Although the pitch of the output sound signal generated by the sound synthesis section (in other words, pitch of the output sound) may be a pitch having no relation to the pitch of the input sound, it is more preferable that the output sound signal be set to a pitch corresponding to the input sound (e.g., pitch substantially identical to the pitch of the input sound or a pitch forming consonance with the input sound). In the preferable embodiment, the spectrum conversion section includes: a pitch conversion section that varies frequencies of individual peaks in the converting spectrum, acquired by the spectrum acquisition section, in accordance with the pitch of the input sound detected by the pitch detection section; and an envelope adjustment section that adjusts a spectrum envelope of the converting spectrum, having frequency components varied by the pitch conversion section, to substantially agree with the spectrum envelope of the input sound detected by the envelope detection section. According to such an embodiment, the output sound signal is adjusted to a pitch corresponding to the input sound, so that the sound audibly reproduced on the basis of the output sound signal can be made auditorily pleasing.

In a more specific embodiment, the pitch conversion section expands or contracts the converting spectrum in accordance with the pitch of the input sound detected by the pitch detection section. According to this embodiment, the converting spectrum can be adjusted in pitch through simple processing of multiplying each of the frequencies of the converting spectrum by a numerical value corresponding to the pitch of the input sound. In another embodiment, the pitch conversion section displaces the frequency of each of spectrum distribution regions, including frequencies of the individual peaks in the converting spectrum (e.g., frequency bands each having a predetermined width centered around the frequency of the peak), in a direction of the frequency axis corresponding to the pitch of the input sound detected by the pitch detection section (see FIG. 8 in the accompanying drawings). According to this embodiment, the frequency of each of the peaks in the converting spectrum can be made to agree with a desired frequency, and thus, the inventive arrangements allow the converting spectrum to be adjusted to the desired pitch with a high accuracy.

Arrangements or construction to adjust the output sound to a pitch corresponding to the input sound may be chosen as desired. For example, the inventive sound processing apparatus may include a pitch detection section for detecting the pitch of the input sound, and the spectrum acquisition section may acquire a converting spectrum of a converting sound, among a plurality of converting sounds differing in pitch from each other, which has a pitch closest to (ideally, identical to) the pitch detected by the pitch detection section (see FIG. 6). Such arrangements can eliminate the need for a particular construction for converting the pitch of the converting spectrum. However, the construction for converting the pitch of the converting spectrum and the construction for selecting any one of the plurality of converting sounds differing in pitch from each other may be used in combination. For example, there may be employed arrangements where the spectrum acquisition section acquires a converting spectrum of a converting sound, among a plurality of the converting sounds corresponding to different pitches, which corresponds to a pitch closest to the pitch of the input sound, and where the pitch conversion section converts the pitch of the selected converting spectrum in accordance with pitch data.

In many cases, frequency spectrums (or spectra) of sounds uttered or generated simultaneously (in parallel) by a plurality of singers or musical instrument performers have bandwidths of individual peaks (i.e., bandwidth W2 shown in FIG. 3) that are greater than bandwidths of individual peaks (i.e., bandwidth W1 shown in FIG. 2) of a sound uttered or generated by a single singer or musical instrument performer. This is because, in so-called unison, sounds uttered or generated by individual singers or musical instrument performers do not exactly agree with each other in pitch.

From the aforementioned viewpoint, a sound processing apparatus according to another aspect of the present invention comprises: an envelope detection section that detects a spectrum envelope of an input sound; a spectrum acquisition section that acquires either a first converting spectrum that is a frequency spectrum of a converting sound, or a second converting spectrum that is a frequency spectrum of a sound having substantially the same pitch as the converting sound indicated by the first converting spectrum and having a greater bandwidth at each peak than the first converting spectrum; a spectrum conversion section that generates an output spectrum created by imparting the spectrum envelope of the input sound, detected by the envelope detection section, to the converting spectrum acquired by the spectrum acquisition section; and a sound synthesis section that synthesize a sound signal on the basis of the output spectrum generated by the spectrum conversion section.

In the sound processing apparatus arranged in the aforementioned manner, the spectrum acquisition section selectively acquires, as a frequency spectrum to be used for generating an output sound signal, either the first converting spectrum or the second converting spectrum, so that it is possible to selectively generate any desired one of an output sound signal of a characteristic corresponding to the first converting spectrum and an output sound signal of a characteristic corresponding to the second converting spectrum. When the first converting spectrum is selected, it is possible to generate an output sound uttered or generated by a single singer or musical instrument performer, while, when the second converting spectrum is selected, it is possible to generate output sounds uttered or generated by a plurality of singers or musical instrument performers. Whereas the sound processing apparatus of the present invention apparatus have been described as selecting the first or second converting spectrum, there may be employed any other converting spectrum for selection as the frequency spectrum to be used for generating an output sound signal. For example, a plurality of converting spectrums differing from each other in bandwidth of each peak may be stored in a storage device so that any one of the stored converting spectrums is selected to be used for generating an output sound signal.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described hereinbelow in greater detail with reference to the accompanying drawings, in which.

DETAILED DESCRIPTION OF THE INVENTION

A. First Embodiment

First, with reference to FIG. 1, a description will be given about an example general setup and behavior of a sound processing apparatus in accordance with a first embodiment of the present invention. Not only in the instant embodiment but also other embodiments to be later described, various components of the sound processing apparatus shown in the figure may be implemented either by an arithmetic operation circuit, such as a CPU (Central Processing Unit), executing a program, or by hardware, such as a DSP, dedicated to sound processing.

Figure 1:
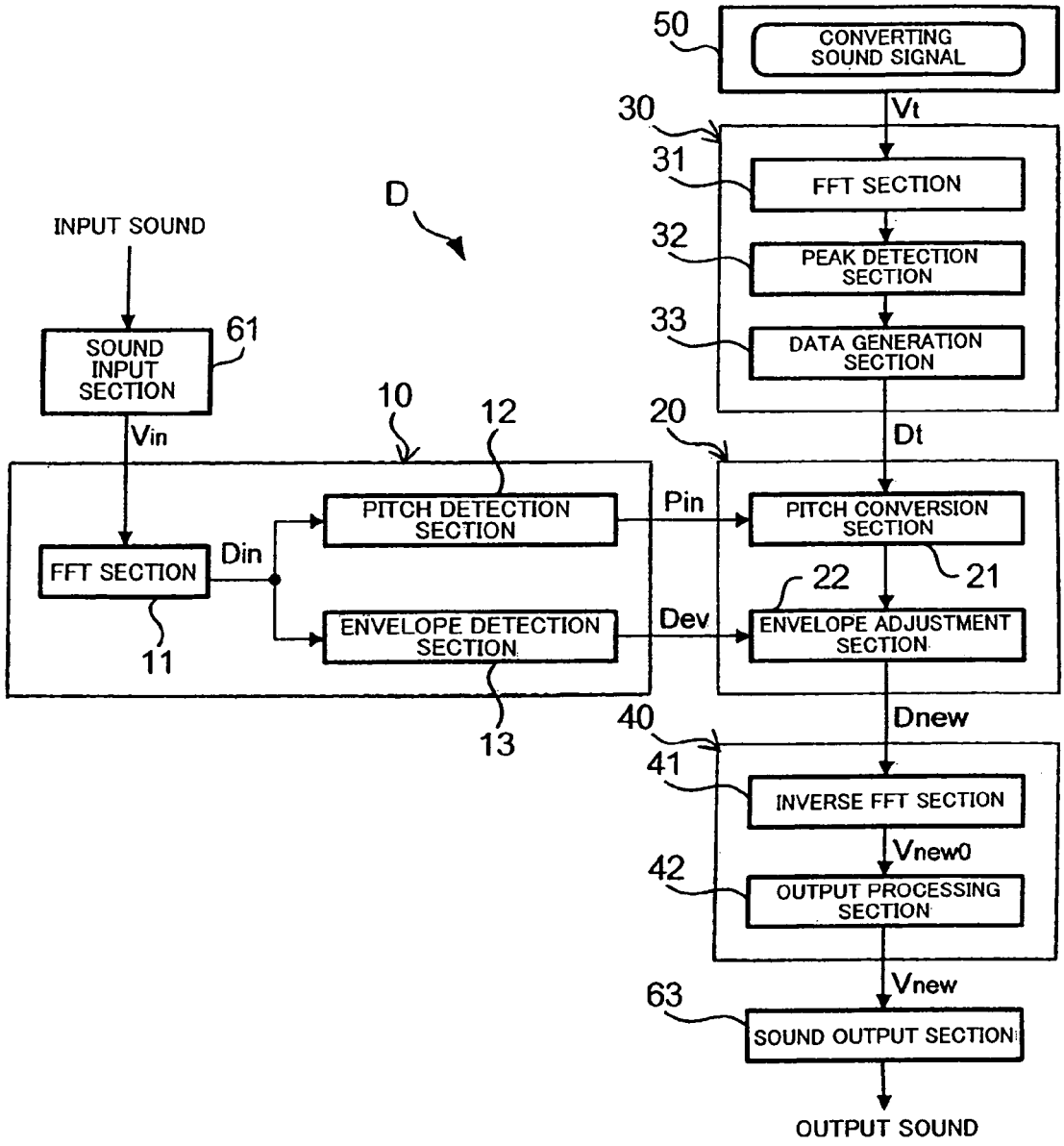
FIG. 1 is a block diagram showing an example general setup of a sound processing apparatus in accordance with a first embodiment of the present invention.

As illustrated in FIG. 1, the sound processing apparatus D of the invention includes a frequency analysis section 10, a spectrum conversion section 20, a spectrum acquisition section 30, a sound generation section 40, and a storage section 50. Sound input section 61 is connected to the frequency analysis section 10. The sound input section 61 is a means for outputting a signal Vin corresponding to an input sound uttered or generated by a user or person (hereinafter referred to as "input sound signal" Vin). This sound input section 61 includes, for example, a sound pickup device (e.g., microphone) for outputting an analog electric signal indicative of a waveform, on the time axis, of each input sound, and an A/D converter for converting the electric signal into a digital input sound signal Vin.

Figure 2:
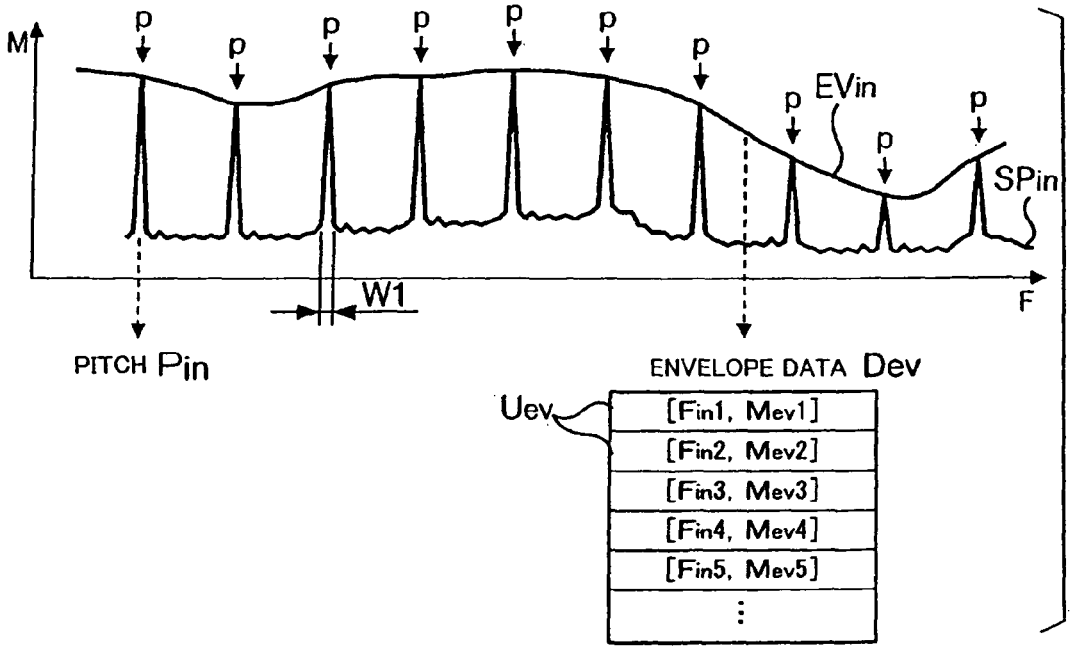
FIG. 2 is a diagram explanatory of processing on an input sound in the embodiment.

The frequency analysis section 10 is a means for identifying a pitch Pin and spectrum envelope EVin of the input sound signal Vin supplied from the sound input section 61. This frequency analysis section 10 includes an FFT (Fast Fourier Transform) section 11, a pitch detection section 12, and an envelope detection section 13. The FFT section 11 cuts or divides the input sound signal Vin, supplied from the sound input section 61, into frames each having a predetermined time length (e.g., 5 ms or 10 ms) and performs frequency analysis, including FFT processing, on each of the frames of the input sound signal Vin to thereby detect a frequency spectrum (hereinafter referred to as "input spectrum") SPin. The individual frames of the input sound signal Vin are set so as to overlap each other on the time axis. Whereas, in the simplest form, these frames are each set to a same time length, they may be set to different time lengths depending on the pitch Pin (detected by a pitch detection section 12 as will be later described) of the input sound signal Vin. In FIG. 2, there is shown an input spectrum SPin identified for a specific one of frames of an input voice uttered or generated by a person. In the illustrated example of the input spectrum SPin in FIG. 2, local peaks p of spectrum intensity M in individual frequencies, representing a fundamental and overtones, each appear in an extremely-narrow bandwidth W1. The FFT section 11 of FIG. 1 outputs, per frame, data indicative of the input spectrum SPin of the input sound signal Vin (hereinafter referred to as "input spectrum data Din") to both the pitch detection section 12 and the envelope detection section 13. The input spectrum data Din includes a plurality of unit data. Each of the unit data is a combination of data indicative of any one of a plurality of frequencies Fin selected at predetermined intervals on the time axis and spectrum intensity Min of the input spectrum SPin at the selected frequency in question.

The pitch detection section 12 shown in FIG. 1 detects the pitch Pin of the input sound on the basis of the input spectrum data Din supplied from the FFT section 11. More specifically, as shown in FIG. 2, the pitch detection section 12 detects, as the pitch Pin of the input sound, a frequency of the peak p corresponding to the fundamental (i.e., peak p of the lowest frequency) in the input spectrum represented by the input spectrum data Din. In the meantime, the envelope detection section 13 detects a spectrum envelope EVin of the input sound. As illustrated in FIG. 2, the spectrum envelope EVin is an envelope curve connecting between the peaks p of the input spectrum Spin. Among ways employable to detect the spectrum envelope EVin are one where linear interpolation is performed between the adjoining peaks p, on the time axis, of the input spectrum SPin to thereby detect the spectrum envelope EVin as broken lines, and one where a curve passing the individual peaks p of the input spectrum SPin is calculated by any of various interpolation processing, such as cubic spline interpolation processing, to thereby detect the spectrum envelope EVin. As seen from FIG. 2, the envelope detection section 13 outputs data Dev indicative of the thus-detected spectrum envelope data EVin (hereinafter referred to as "envelope data"). The envelope data Dev comprises a plurality of unit data Uev similarly to the input spectrum data Din. Each of the unit data Uev is a combination of data indicative of any one of a plurality of frequencies Fin (Fin1, Fin2, . . . ) selected at predetermined intervals on the time axis and spectrum intensity Mev (Mev1, Mev2, . . . ) of the spectrum envelope Evin at the selected frequency Fin in question.

The spectrum conversion section 20 shown in FIG. 1 is a means for generating data Dnew indicative of a frequency spectrum of an output sound (hereinafter referred to as "output spectrum SPnew") created by varying a characteristic of the input sound; such data Dnew will hereinafter be referred to as "new spectrum data Dnew". The spectrum conversion section 20 in the instant embodiment identifies the frequency spectrum SPnew of the output sound on the basis of a frequency spectrum of a previously-prepared specific sound (hereinafter referred to as "converting sound") and the spectrum envelope Vin of the input sound; the frequency spectrum of the converting sound will hereinafter be referred to as "converting spectrum SPt". Procedures for generating the frequency spectrum SPnew will be described later.

The spectrum acquisition section 30 is a means for acquiring the converting spectrum SPt, and it includes an FFT section 31, peak detection section 32 and data generation section 33. To the FFT section 31 is supplied a converting sound signal Vt read out from a storage section 50, such as a hard disk device. The converting sound signal Vt is a signal of a time-domain representing a waveform of the converting sound over a specific section (i.e., time length) and stored in advance in the storage section 50. The FFT section 31 cuts or divides each of the converting sound signal Vt, sequentially supplied from the storage section 50, into frames of a predetermined time length and performs frequency analysis, including FFT processing, on each of the frames of the converting sound signal Vt to thereby detect a converting spectrum SPt, in a similar manner to the above-described procedures pertaining to the input sound. The peak detection section 32 detects peaks pt of the converting spectrum SPt identified by the FFT section 31 and then detects respective frequencies of the peaks pt. Here, there is employed a peak detection scheme where a particular peak, having the greatest spectrum intensity among all of a predetermined number of peaks adjoining each other on the frequency axis, is detected as the peak pt.

Figure 3:
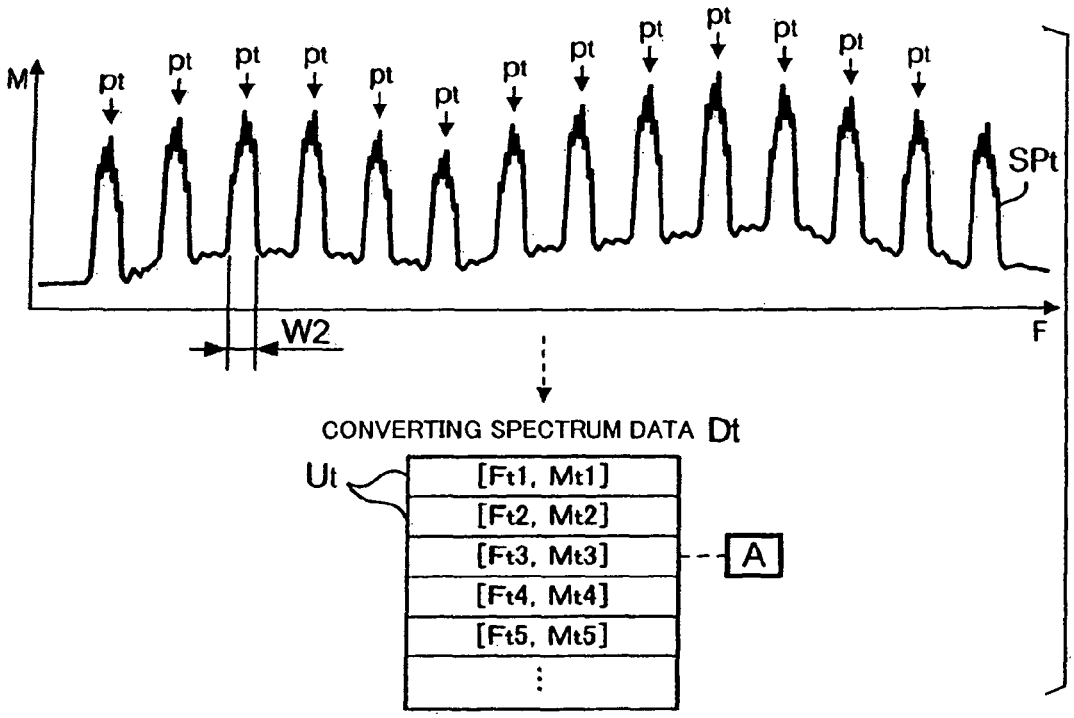
FIG. 3 is a diagram explanatory of processing on a converting sound signal in the embodiment.

The instant embodiment assumes, for description purposes, a case where sound signals obtained by the sound pickup device, such as a microphone, picking up sounds uttered or generated by a plurality of persons simultaneously at substantially the same pitch Pt (i.e., sounds generated in unison, such as ensemble singing or music instrument performance) are stored, as converting sound signals Vt, in advance in the storage section 50. Converting spectrum SPt obtained by performing, per predetermined frame section, FFT processing on such a converting sound signal Vt is similar to the input spectrum SPin of FIG. 1 in that local peaks pt of spectrum intensity M appear in individual frequencies that represent the fundamental and overtones corresponding to the pitch Pt of the converting sound as shown in FIG. 3. However, the converting spectrum SPt is characterized in that bandwidths W2 of formants corresponding to the peaks pt are greater than the bandwidths W1 of the individual peaks p of the input spectrum SPin of FIG. 1. The reason why the bandwidth W2 of each of the peaks pt is greater is that the sounds uttered or generated by the plurality of persons do not completely agree in pitch with each other.

The data generation section 33 shown in FIG. 1 is a means for generating data Dt representative of the converting spectrum SPt (hereinafter referred to as "converting spectrum data Dt"). As seen in FIG. 3, the converting spectrum data Dt includes a plurality of unit data Ut and designator A. Similarly to the unit data of the envelope data Dev, each of the unit data Ut is a combination of data indicative of any one of a plurality of frequencies Ft (Ft1, Ft2, . . . ) selected at predetermined intervals on the time axis and spectrum intensity Mt (Mt1, Mt2, . . . ) of the converting spectrum SPt of the selected frequency Ft in question. The designator A is data (e.g., flag) that designates any one of peaks pt of the converting spectrum SPt; more specifically, the designator A is selectively added to one of all of the unit data, included in the converting spectrum data Dt, which corresponds to the peak pt detected by the peak detection section 32. If the peak detection section 32 has detected a peak pt in the frequency Ft3, for example, the designator A is added to the unit data including that frequency Ft3, as illustrated in FIG. 3; the designator A is not added to any of the other unit data Ut (i.e., unit data Ut corresponding to frequencies other than the peak pt). The converting spectrum data Dt is generated in a time-serial manner on a frame-by-frame basis.

As seen in FIG. 1, the spectrum conversion section 20 includes a pitch conversion section 21 and an envelope adjustment section 22. The converting spectrum data Dt output from the spectrum acquisition section 30 is supplied to the pitch conversion section 21. The pitch conversion section 21 varies the frequency of each peak pt of the converting spectrum SPt indicated by the converting spectrum data Dt in accordance with the pitch Pin detected by the pitch detection section 12. In the instant embodiment, the pitch conversion section 21 converts the converting spectrum SPt so that the pitch Pt of the converting sound represented by the converting spectrum data Dt substantially agrees with the pitch Pin of the input sound detected by the pitch detection section 12. Procedures of such spectrum conversion will be described below with reference to FIG. 4.

Figure 4:
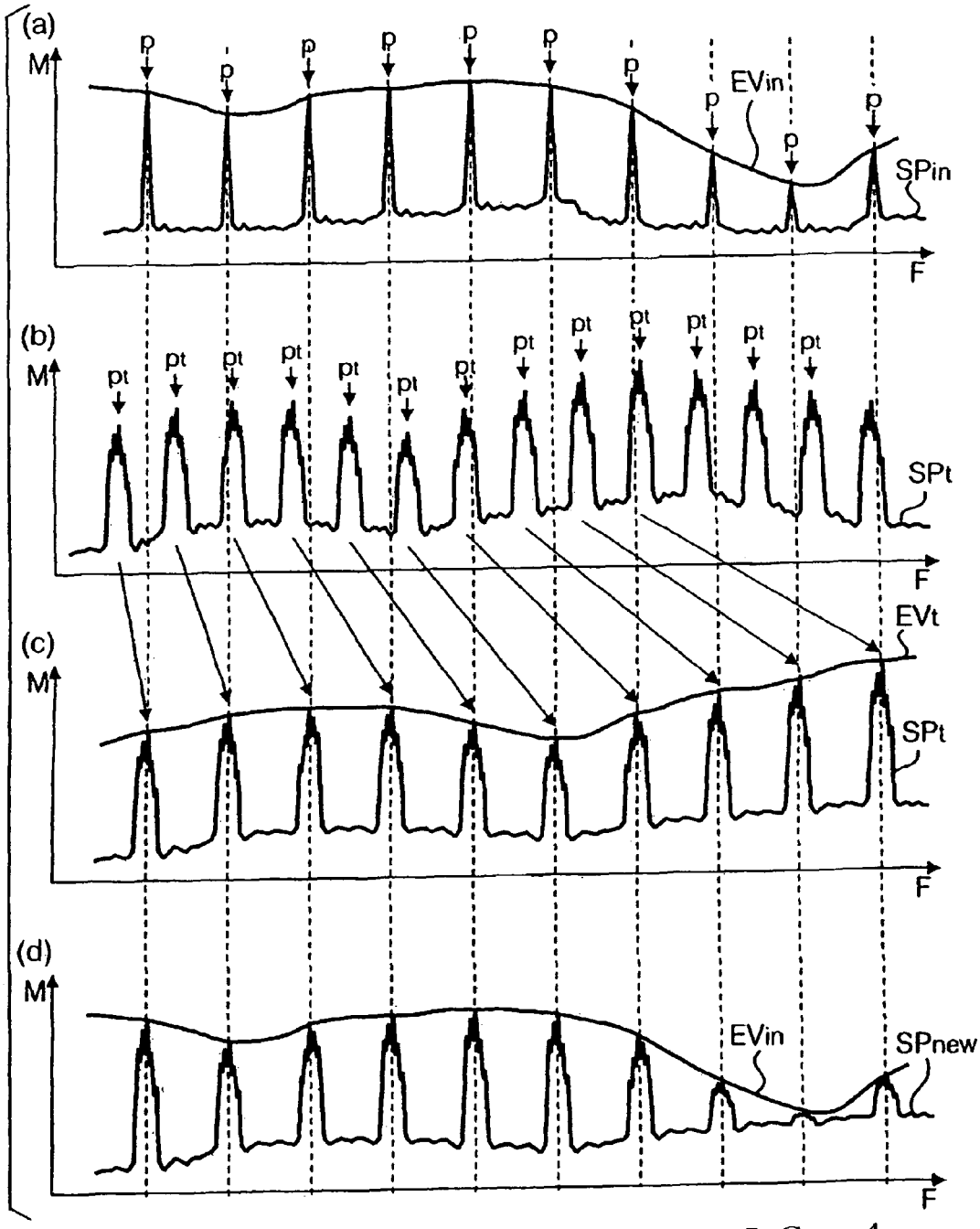
FIG. 4 is a diagram explanatory of details of processing by a spectrum conversion section in the embodiment.

In section (b) of FIG. 4, there is illustrated the converting spectrum SPt shown in FIG. 3. Further, in section (a) of FIG. 4, there is illustrated the input spectrum SPin (shown in FIG. 2) for comparison with the converting spectrum SPt. Because the pitch Pin of the input sound differs depending on the manner of utterance or generation by each individual person, frequencies of individual peaks p in the input spectrum SPin and frequencies of individual peaks pt in the converting spectrum SPt do not necessarily agree with each other, as seen from sections (a) and (b) of FIG. 4. Thus, the pitch conversion section 21 expands or contracts the converting spectrum SPt in the frequency axis direction, to thereby allow the frequencies of the individual peaks p in the converting spectrum SPt to agree with the frequencies of the corresponding peaks p in the input spectrum SPin. More specifically, the pitch conversion section 21 calculates a ratio "Pin/Pt" between the pitch Pin of the input sound detected by the pitch detection section 12 and the pitch Pt of the converting sound and multiplies the frequency Ft of each of the unit data Ut, constituting the converting spectrum data Dt, by the ratio "Pin/Pt". For example, the frequency of the peak corresponding to the fundamental (i.e., the peak pt of the lowest frequency) among the many peaks pt of the converting spectrum SPt is identified as the pitch Pt of the converting sound. Through such processing, the individual peaks of the converting spectrum SPt are displaced to the frequencies of the corresponding peaks p of the input spectrum SPin, as a result of which the pitch Pt of the converting sound can substantially agree with the pitch Pin of the input sound. The pitch conversion section 21 outputs, to the envelope adjustment section 22, converting spectrum data Dt representative of the converting spectrum thus converted in pitch.

The envelope adjustment section 22 is a means for adjusting the spectrum intensity M (in other words, spectrum envelope EVt) of the converting spectrum SPt, represented by the converting spectrum data Dt, to generate a new spectrum SPnew. More specifically, the envelope adjustment section 22 adjusts the spectrum intensity M of the converting spectrum SPt so that the spectrum envelope of the new spectrum SPnew substantially agrees with the spectrum envelope detected by the envelope detection section 13, as seen section (d) of FIG. 4. Specific example scheme to adjust the spectrum intensity M will be described below.

The envelope adjustment section 22 first selects, from the converting spectrum data Dt, one particular unit data Ut having the designator A added thereto. This particular unit data Ut includes the frequency Ft of any one of the peaks pt (hereinafter referred to as "object-of-attention peak pt") in the converting spectrum SPt, and the spectrum intensity Mt (see FIG. 3). Then, the envelope adjustment section 22 selects, from among the envelope data Dev supplied from the envelope detection section 13, unit data Uev approximate to or identical to the frequency Ft of the object-of-attention peak pt. After that, the envelope adjustment section 22 calculates a ratio "Mev/Mt" between the spectrum intensity Mev included in the selected unit data Uev and the spectrum intensity Mt of the object-of-attention peak pt and multiplies the spectrum intensity Mt of each of the unit data Ut of the converting spectrum SPt, belonging to a predetermined band centered around the object-of-attention peak pt, by the ratio Mev/Mt. Repeating such a series of operations for each of the peaks pt of the converting spectrum SPt allows the new spectrum Spnew to assume a shape where the apexes of the individual peaks are located on the spectrum envelope Evin. The envelope adjustment section 22 outputs new spectrum data Dnew representative of the new spectrum Spnew.

The operations by the pitch conversion section 21 and envelope adjustment section 22 are performed for each of the frames provided by dividing the input sound signal Vin. However, in many cases, the frames of the input sound and the frames of the converting sound do not agree with each other, because the number of the frames of the input sound differs depending on the time length of utterance or generation of the sound by the person while the number of the frames of the converting sound is limited by the time length of the converting sound signal Vt stored in the storage section 50. Where the number of the frames of the converting sound is greater than that of the input sound, then it is only necessary to discard a portion of the converting spectrum data Dt corresponding to the excess frame or frames. On the other hand, where the number of the frames of the converting sound is smaller than that of the input sound, it is only necessary to use the converting spectrum data Dt in a looped fashion, e.g. by, after having used the converting spectrum data Dt corresponding to all of the frames, reverting to the first frame to again use the converting spectrum data Dt of the frame. In any case, it is only necessary that any portion of the data Dt be used by any suitable scheme without being limited to the looping scheme, in connection with which arrangements are of course employed to detect a time length over which the utterance or generation of the input sound is lasting.

Further, the sound generation section 40 of FIG. 1 is a means for generating an output sound signal Vnew of the time domain on the basis of the new spectrum SPnew, and it includes an inverse FFT section 41 and an output processing section 42. The inverse FFT section 42 performs inverse FFT processing on the new spectrum data Dnew output from the envelope adjustment section 22 per frame, to thereby generate an output sound signal Vnew0 of the time domain. The output processing section 42 multiplies the thus-generated output sound signal Vnew0 of each of the frames by a predetermined time window function and then connects together the multiplied signals in such a manner that the multiplied signals overlap each other on the time axis, to thereby generate the output sound signal Vnew. The output sound signal Vnew is supplied to a sound output section 63. The sound output section 63 includes a D/A converter for converting the output sound signal Vnew into an analog electric signal, and a sounding device, such as a speaker or headphones, for audibly reproducing or sounding the output signal supplied from the D/A converter.

In the instant embodiment, where the spectrum envelope EVt of the converting sound including a plurality of sounds uttered or generated in parallel by a plurality of persons is adjusted to substantially agree with the spectrum envelope Evin of the input sound as set forth above, there can be generated an output sound signal Vnew indicative of a plurality of sounds (i.e., sounds of ensemble singing or musical instrument performance) having similar phonemes to the input sound. Consequently, even where a sound or performance sound uttered or generated by a single person has been input, the sound output section 63 can produce an output sound as if ensemble singing or musical instrument performance were being executed by a plurality of sound utters or musical instrument performers. Besides, there is no need to provide arrangements for varying an input sound characteristic for each of a plurality of sounds. In this manner, the sound processing apparatus D of the present invention can be greatly simplified in construction as compared to the arrangements disclosed in the above-discussed patent literature. Further, in the instant embodiment, the pitch Pt of the converting sound is converted in accordance with the pitch Pin of the input sound, so that it is possible to generate sounds of ensemble singing or ensemble musical instrument performance at any desired pitch. Further, the instant embodiment is advantageous in that the pitch conversion can be performed by simple processing (e.g., multiplication processing) of expanding or contracting the converting spectrum SPt in the frequency axis direction.

B. Second Embodiment

Next, a description will be given about a sound processing apparatus in accordance with a second embodiment of the present invention with primary reference to FIG. 5, where the same elements as in the above-described first embodiment are represented by the same reference characters and will not be described in detail to avoid unnecessary duplication.

Figure 5:
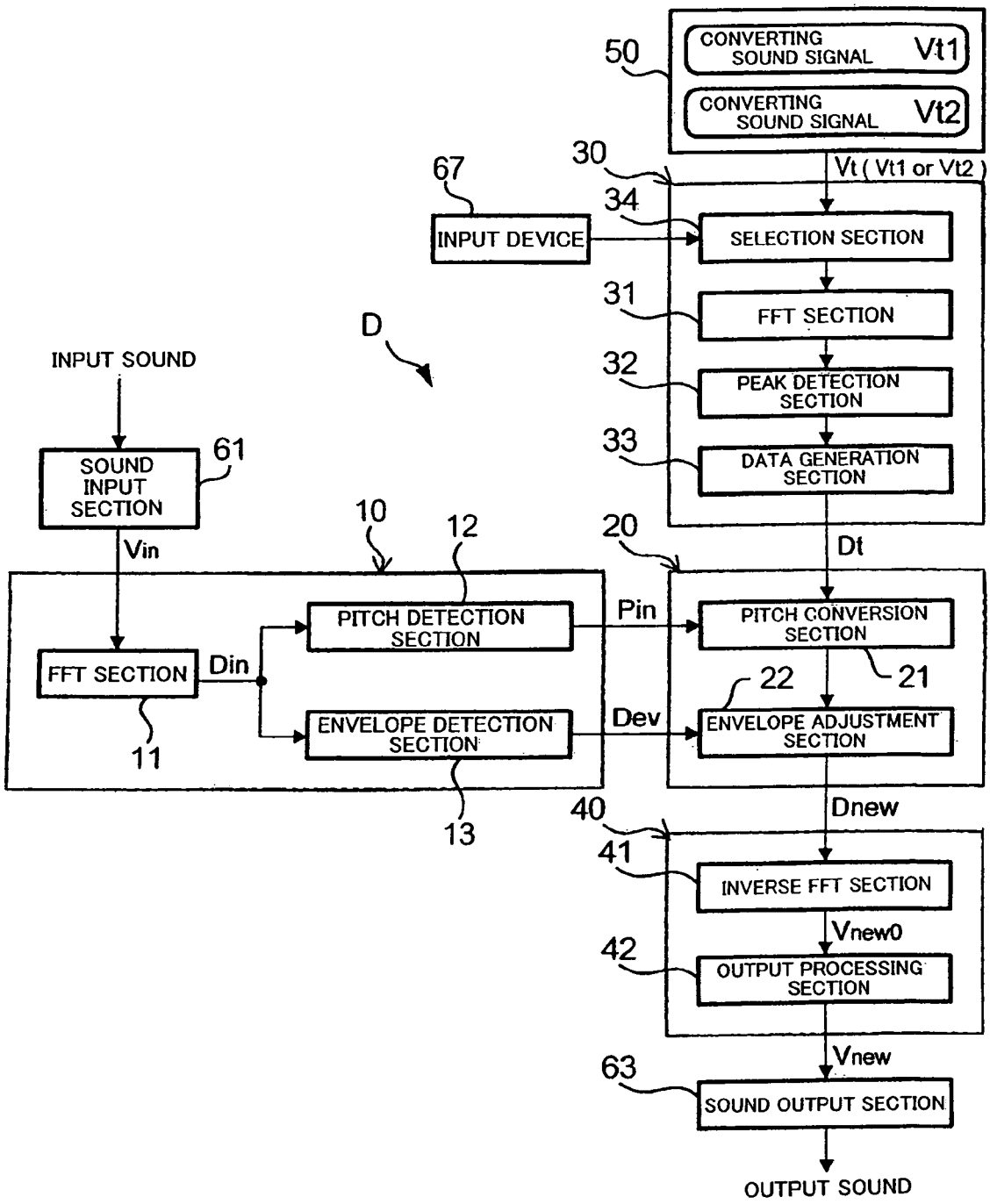
FIG. 5 is a block diagram showing an example general setup of a sound processing apparatus in accordance with a second embodiment of the present invention.

FIG. 5 is a block diagram showing an example general setup of the second embodiment of the sound processing apparatus D. As shown, the second embodiment is generally similar in construction to the first embodiment, except for stored contents in the storage section 50 and construction of the spectrum acquisition section 30. In the second embodiment, first and second converting sound signals Vt1 and Vt2 are stored in the storage section 50. The first and second converting sound signals Vt1 and Vt2 are both signals obtained by picking up converting sounds uttered or generated at generally the same pitch Pt. However, while the first converting sound signal Vt1 is a signal indicative of a waveform of a single sound (i.e., sound uttered by a single person or performance sound generated by a single musical instrument) similarly to the input sound signal Vin shown in FIG. 2, the second converting sound signal Vt2 is a signal obtained by picking up a plurality of parallel-generated converting sounds (i.e., sounds uttered by a plurality of persons or performance sounds generated by a plurality of musical instruments). Therefore, a bandwidth of each peak in a converting spectrum SPt (see W2 in FIG. 3) identified from the second converting sound signal Vt2 is greater than a bandwidth of each peak of a converting spectrum SPt (see W1 in FIG. 1) identified from the first converting sound signal Vt1.

Further, in the second embodiment, the spectrum acquisition section 30 includes a selection section 34 at a stage preceding the FFT section 31. The selection section 34 selects either one of the first and second converting sound signals Vt1 and Vt2 on the basis of a selection signal supplied externally and then reads out the selected converting sound signal Vt (Vt1 or Vt2) from the storage section 50. The selection signal is supplied from an external source in response to operation on an input device 67. The converting sound signal Vt read out by the selection section 34 is supplied to the FFT section 31. Construction and operation of the elements following the selection section 34 is the same as in the first embodiment and will not be described here.

Namely, in the instant embodiment, either one of the first and second converting sound signals Vt1 and Vt2 is selectively used in generation of the new spectrum SPnew. When the first converting sound signal Vt1 is selected, a single sound is output which contains both phonemes of the input sound and frequency characteristic of the input sound. When, on the other hand, the second converting sound signal Vt2 is selected, a plurality of sounds are output which maintain the phonemes of the input sound as in the first embodiment.

Namely, in the second embodiment, the user can select as desired whether a single sound or plurality of sounds should be output.

Whereas the second embodiment has been described above as constructed so that a desired converting sound signal Vt is selected in response to operation on the input device 67, the selection of the desired converting sound signal Vt may be made in any other suitable manner. For example, switching may be made between the first converting sound signal Vt1 and the second converting sound signal Vt2 in response to each predetermined one of time interrupt signals generated at predetermined time intervals. Further, in a case where the embodiment of the sound processing apparatus D is applied to a karaoke apparatus, switching may be made between the first converting sound signal Vt1 and the second converting sound signal Vt2 in synchronism with a progression of a music piece performed on the karaoke apparatus. Further, whereas the second embodiment has been described in relation to the case where the first converting sound signal Vt1 representative of a single sound and the second converting sound signal Vt2 representative of a plurality of sounds are stored in advance in the storage section 50, the respective numbers of sounds represented by the first and second converting sound signals Vt1 and Vt2 are not limited to the aforementioned. For example, the first converting sound signal Vt1 used in the instant embodiment may be a signal representative of a predetermined number of sounds uttered or generated in parallel, and the converting sound signal Vt2 may be a signal representative of another predetermined number of sounds which is greater than the number of sounds represented by the first converting sound signal Vt1.

C. Modification

The above-described embodiments may be modified variously, and some specific examples of modifications are set forth below. These examples of modifications may be used in combination as necessary.

Figure 6:
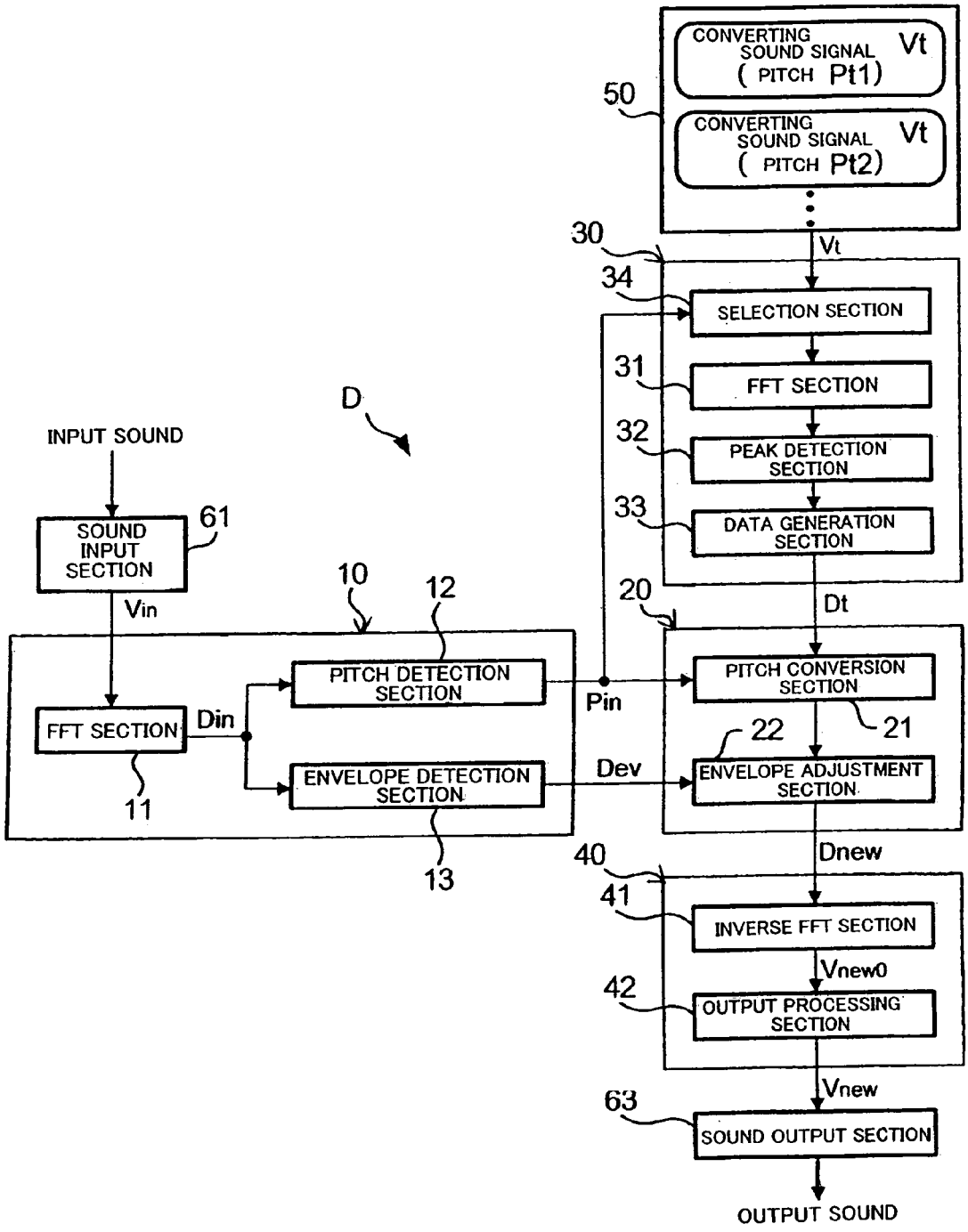
FIG. 6 is a block diagram showing an example general setup of a sound processing apparatus in accordance with a modification of the present invention.

(1) Whereas each of the embodiments has been described in relation to the case where a converting sound signal Vt (Vt1 or Vt2) of a single pitch Pt is stored in the storage section 50, a plurality of converting sound signals Vt of different pitches Pt (Pt1, Pt2, . . . ) may be stored in advance in the storage section 50. Each of the converting sound signals Vt is a signal obtained by picking up a converting sound including a plurality of sounds uttered or generated in parallel. The sound processing apparatus illustrated in FIG. 6 is arranged in such a manner that the pitch Pin detected by the pitch detection section 12 is also supplied to the selection section 34 of the spectrum acquisition section 30. The selection section 34 selectively reads out, from the storage section 50, a converting sound signal Vt of a pitch approximate or identical to the pitch Pin of the input sound. With such arrangements, there can be used, as the converting sound signal Vt for use in generation of a new spectrum Spnew, a sound signal of a pitch Pt close to the pitch Pin of the input sound signal Vin, and thus, it is possible to reduce an amount by which the frequency of each of the peaks pt of the converting spectrum SPt has to be varied through the processing by the pitch conversion section 21. Therefore, the arrangements can advantageously generate a new spectrum Spnew of a natural shape. Although the embodiments have been described above as executing the processing by the pitch conversion section 21 in addition to the selection of the converting sound signal Vt, the pitch conversion section 21 is not necessarily an essential element, because an output sound of any desired pitch can be produced by the selection of the converting sound signal V1 alone, provided that converting sound signals of a plurality of pitches Pt are stored in advance in the storage section 50. The selection section 34 may be constructed to select from among a plurality of converting spectrum data D created and stored in advance in correspondence with individual pitches Pt1, Pt2, . . . .

Figure 7:
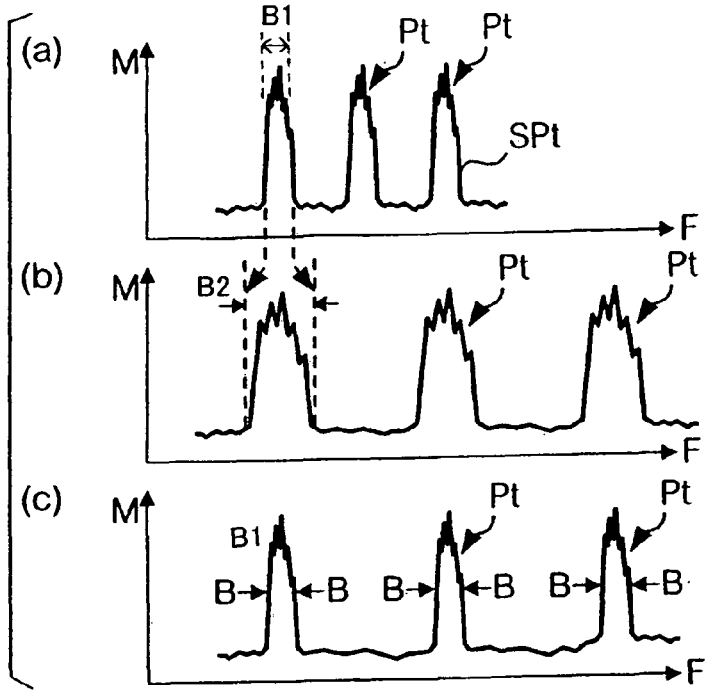
FIG. 7 is a diagram explanatory of pitch conversion in the modified sound processing apparatus of FIG. 6.

(2) Further, whereas each of the embodiments has been described above in relation to the case where the frequency Ft included in each of the unit data Ut of the converting spectrum data Dt is multiplied by a particular numerical value (ratio "Pin/Pt"), to thereby expand or contract the converting spectrum SPt in the frequency axis direction, the scheme to convert the pitch Pt of the converting spectrum SPt may be changed as desired. For example, with the conversion schemes employed in the above-described embodiments, the converting spectrum SPt is expanded or contracted at the same rate throughout the entire band thereof, there may be a possibility of the bandwidth B2 of each of the peaks pt, having been subjected to the expansion/contraction control, notably expanding as compared the bandwidth B1 of the original pt. If, for example, the pitch Pt of the converting spectrum SPt shown in section (a) of FIG. 7 is converted to twice the pitch pt in accordance with the scheme employed in the first embodiment, then the bandwidth B2 of each of the peaks pt would double as seen in section (b) of FIG. 7. If the spectrum shape of each of the peaks varies greatly in this manner, there will be generated an output sound significantly different in characteristic from the converting sound. To avoid such an inconvenience, the pitch conversion section 21 may perform, on the frequency Ft of each of the unit data Ut, arithmetic operations for narrowing the bandwidth B2 of each of the peaks pt of the converting spectrum SPt, obtained by multiplication by the particular numeric value (ratio "Pin/Pt"), (i.e., frequency spectrum shown in section (b) of FIG. 7) to the bandwidth B1 of the peak pt before having been subjected to the pitch conversion. With such arrangements, it is possible to produce an output sound faithfully reproducing the characteristics of the converting sound.

Figure 8:
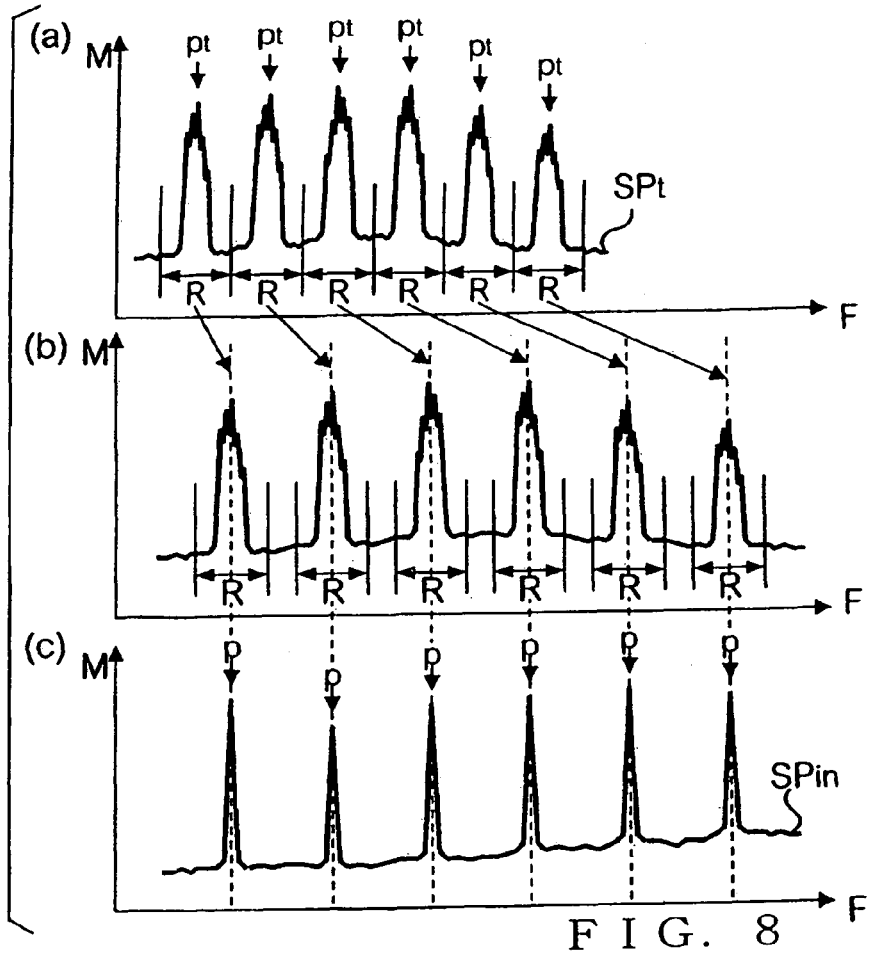
FIG. 8 is a diagram explanatory of pitch conversion in the modified sound processing apparatus.

Further, whereas the embodiments have been described above in relation to the case where the pitch Pt is converted through the multiplication operation performed on the frequency F of each of the unit data Ut, the pitch Pt may be varied by dividing the converting spectrum SPt into a plurality of bands (hereinafter referred to as "spectrum distribution regions R") on the time axis and displacing each of the spectrum distribution regions R in the frequency axis direction. Each of the spectrum distribution regions R is selected to include one peak pt and bands preceding and following (i.e., centered around) the peak pt. The pitch conversion section 21 displaces each of the spectrum distribution regions R in the frequency axis direction so that the frequencies of the peaks pt belonging to the individual spectrum distribution regions R substantially agree with the corresponding peaks p appearing in the input spectrum SPin (see section (c) of FIG. 8) as illustratively shown in section (b) of FIG. 8. Although there occur bands with no frequency spectrum between adjacent individual spectrum distribution regions R, the spectrum intensity M may be set at a predetermined value (such as zero) for each of such bands. Because such processing reliably allows the frequency of each of the peaks pt of the converting spectrum SPt to agree with the frequency of the corresponding peak pt of the input sound, it is possible to generate an output sound of any desired pitch with a high accuracy.

(3) Further, whereas each of the embodiments has been described as identifying a converting spectrum SPt from a converting sound signal Vt stored in the storage section 50, it may employ an alternative scheme where converting spectrum data Dt representative of a converting spectrum SPt is prestored per frame in the storage section 50. According to such a scheme, the spectrum acquisition section 30 only has to read out the converting spectrum data Dt from the storage section 50 and then output the read-out converting spectrum data Dt to the spectrum conversion section 20; in this case, the spectrum acquisition section 30 need not be provided with the FFT section 31, peak detection section 32 and data generation section 33. Furthermore, whereas each of the embodiments has been described above as prestoring converting spectrum data Dt in the storage section 50, the spectrum acquisition section 30 may be arranged to acquire converting spectrum data Dt, for example, from an external communication device connected thereto via a communication line. Namely, the spectrum acquisition section 30 only has to be a means capable of acquiring a converting spectrum SPt, and it does not matter how and from which source a converting spectrum SPt is acquired.

(4) Further, whereas each of the embodiments has been described above as detecting the pitch Pin from the frequency spectrum SPin of the input sound, the pitch Pin may be detected in any other suitable manner than the above-described. For example, the pitch Pin may be detected from the time-domain input sound signal Vin supplied from the sound input section 61. The detection of the pitch Pin may be made in any of the various conventionally-known manners.

(5) Furthermore, whereas each of the embodiments has been described above in relation to the case where the pitch Pt of the converting sound is adjusted to agree with the pitch Pin of the input sound, the pitch Pt of the converting sound may be converted to a pitch other than the pitch Pt of the input sound. For example, the pitch conversion section 21 may be arranged to convert the pitch Pt of the converting sound to assume a pitch that forms consonance with the pitch Pt of the input sound. In addition, the output sound signal Vnew supplied from the output processing section 42 and the input sound signal Vin received from the sound input section 61 may be added together so that the sum of the two signals Vnew and Vin is output from the sound output section 63, in which case it is possible to output chorus sounds along with the input sound uttered or generated by a user. Namely, in the implementation provided with the pitch conversion section 21, it is only necessary that the pitch conversion section 21 vary the pitch Pt of the converting sound in accordance with the pitch of the input sound Pin (so that the pitch Pt of the converting sound varies in accordance with variation in the pitch Pin).

What is claimed is:

1. A sound processing apparatus comprising:

a pitch detection section that detects a pitch of an input sound;

an envelope detection section that detects a spectrum envelope of the input sound;

a spectrum acquisition section that acquires converting spectrums that are frequency spectrums of a converting sound comprising a plurality of sounds;

a spectrum conversion section that generates output spectrums created by imparting the spectrum envelope of the input sound, detected by said envelope detection section, to the converting spectrums acquired by said spectrum acquisition section; and a sound synthesis section that synthesizes a sound signal on the basis of the output spectrums generated by said spectrum conversion section, wherein said plurality of sounds included in said converting sound have been sounded in parallel from different sound sources, said converting spectrums having a plurality of peaks, a band of each of the peaks being wider than a corresponding band of each peak of spectrums of the input sound, and wherein, as data representative of the converting spectrums acquired by said spectrum acquisition section, said spectrum acquisition section supplies, for each spectrum composing the converting spectrums, unit data composed of data indicative of a frequency and intensity of the spectrum at the frequency, and wherein said spectrum conversion section includes:

a pitch conversion section that varies, in accordance with the pitch of the input sound detected by said pitch detection section, the frequency indicated by the unit data of each spectrum of the converting spectrums; and an envelope adjustment section that adjusts a spectrum envelope of the converting spectrums, having the frequencies varied by said pitch conversion section, to substantially agree with the spectrum envelope of the input sound detected by said envelope detection section, wherein, for each of the peaks in the converting spectrums, said envelope adjustment section determines an intensity of a frequency in the spectrum envelope of the input sound, said frequency in the spectrum envelope of the input sound corresponding to the frequency of the peak in the converting spectrum, determines a ratio between the determined intensity of the frequency in the spectrum envelope of the input sound and the intensity of a frequency in the converting spectrums as indicated by the unit data, said frequency in the converting spectrum corresponding to the peak in the converting spectrum, and multiplies an intensity of the unit data of each spectrum belonging to the band centered around said peak in the converting spectrums, by the determined ratio, wherein the spectrum envelope of the converting spectrums substantially agree with the spectrum envelope of the input sound.

2. A sound processing apparatus as claimed in claim 1 wherein said pitch conversion section expands or reduces a whole of the converting spectrum in accordance with the pitch of the input sound detected by said pitch detection section.

3. A sound processing apparatus as claimed in claim 1 wherein said pitch conversion section displaces the frequency of each of the peaks in accordance with the pitch of the input sound while maintaining spectrum distribution regions formed around each of the peaks.

4. A sound processing apparatus as claimed in claim 1 wherein said spectrum acquisition section acquires converting spectrums of a converting sound, among a plurality of the converting sounds differing from each other in fundamental pitch, which has a fundamental pitch closest to the pitch detected by said pitch detection section.

5. A sound processing apparatus as claimed in claim 1 wherein the converting sound of the converting spectrums acquired by said spectrum acquisition section comprises a plurality of sounds uttered in unison.

6. A sound processing apparatus as claimed in claim 1 wherein said spectrum acquisition section acquires the converting spectrums that vary over time.

7. A sound processing apparatus as claimed in claim 1 wherein said sound synthesis section synthesizes a sound signal based on the output spectrums as long as generation of the input sound lasts.

8. A sound processing apparatus as claimed in claim 7 wherein said spectrum acquisition section sequentially acquires a limited plurality of the converting spectrums in accordance with passage of time, and said spectrum acquisition section re-acquires any of the limited plurality of the converting spectrums as long as the generation of the input sound lasts.

9. A sound processing apparatus as claimed in claim 1 which is provided as an attachment to a karaoke apparatus, and wherein the input sound is a sound signal picked up by a microphone of the karaoke apparatus.

10. A sound processing apparatus comprising:

a pitch detection section that detects a pitch of an input sound;

an envelope detection section that detects a spectrum envelope of the input sound;

a spectrum acquisition section that acquires converting spectrums that are frequency spectrums of a converting sound;

a spectrum conversion section that generates output spectrums created by imparting the spectrum envelope of the input sound, detected by said envelope detection section, to the converting spectrums acquired by said spectrum acquisition section; and a sound synthesis section that synthesizes a sound signal on the basis of the output spectrum generated by said spectrum conversion section, wherein said spectrum acquisition section selectively acquires either one of first converting spectrums that are frequency spectrums of a first converting sound having a plurality of peaks, or second converting spectrums that are frequency spectrums of a second converting sound having substantially a same pitch as the first converting sound indicated by said first converting spectrums and having a plurality of peaks of a greater bandwidth at each peak than said first converting spectrums, at least said second converting sound comprising a plurality of sounds which have been sounded in parallel from different sound sources, a band of each of the peaks in at least said second converting spectrums being wider than a band of each peak of spectrums of the input sound, and wherein, as data representative of the converting spectrums acquired by said spectrum acquisition section, said spectrum acquisition section supplies, for each spectrum composing the converting spectrums, unit data composed of data indicative of a frequency and intensity of the spectrum at the frequency, and wherein said spectrum conversion section includes:

a pitch conversion section that varies, in accordance with the pitch of the input sound detected by said pitch detection section, the frequency indicated by the unit data of each spectrum of the converting spectrums supplied by said spectrum acquisition section; and an envelope adjustment section that adjusts a spectrum envelope of the converting spectrums, having the frequencies varied by said pitch conversion section, to substantially agree with the spectrum envelope of the input sound detected by said envelope detection section, wherein, for each of the peaks in the converting spectrums, said envelope adjustment section determines an intensity of a frequency in the spectrum envelope of the input sound, said frequency in the spectrum envelope of the input sound corresponding to the frequency of the peak in the converting spectrum, determines a ratio between the determined intensity of the frequency in the spectrum envelope of the input sound and the intensity of a frequency in the converting spectrums as indicated by the unit data, said frequency in the converting spectrum corresponding to the peak in the converting spectrum, and multiplies an intensity of the unit data of each spectrum belonging to the band centered around said peak in the converting spectrums, by the determined ratio, wherein the spectrum envelope of the converting spectrums substantially agree with the spectrum envelope of the input sound.

11. A sound processing apparatus 10 wherein said first converting sound comprises a single sound.

12. A sound processing apparatus 10 wherein the first converting sound comprises a plurality of sounds different from the second converting sound.

13. A method for processing an input sound, said method comprising:

a step of detecting a pitch of an input sound;

a step of detecting a spectrum envelope of the input sound;

a step of acquiring converting spectrums that is frequency spectrums of a converting sound comprising a plurality of sounds;

a step of generating output spectrums created by imparting the spectrum envelope of the input sound, detected by said step of detecting, to the converting spectrums acquired by said step of acquiring; and a step of synthesizing a sound signal on the basis of the output spectrums generated by said step of generating, wherein said plurality of sounds included in said converting sound have been sounded in parallel from different sound sources, said converting spectrums having a plurality of peaks, a band of each of the peaks being wider than a corresponding band of each peak of spectrums of the input sound, and wherein, as data representative of the converting spectrums acquired by said step of acquiring, said step of acquiring supplies, for each spectrum composing the converting spectrums, unit data composed of data indicative of a frequency and intensity of the spectrum at the frequency, and wherein said step of generating includes:

a pitch conversion step of varying, in accordance with the pitch of the input sound detected by said step of detecting a pitch of an input sound, the frequency indicated by the unit data of each spectrum of the converting spectrums; and an envelope adjustment step of adjusting a spectrum envelope of the converting spectrums, having the frequencies varied by said pitch conversion step, to substantially agree with the spectrum envelope of the input sound detected by said step of detecting a spectrum envelope of the input sound, wherein, for each of the peaks in the converting spectrums, said envelope adjustment step determines an intensity of a frequency in the spectrum envelope of the input sound, said frequency in the spectrum envelope of the input sound corresponding to the frequency of the peak in the converting spectrum, determines a ratio between the determined intensity of the frequency in the spectrum envelope of the input sound and the intensity of a frequency in the converting spectrums as indicated by the unit data, said frequency in the converting spectrum corresponding to the peak in the converting spectrum, and multiplies an intensity of the unit data of each spectrum belonging to the band centered around said peak in the converting spectrums, by the determined ratio, wherein the spectrum envelope of the converting spectrums substantially agree with the spectrum envelope of the input sound.

14. A computer-readable medium containing a group of instructions for causing a computer to execute a procedure for processing an input sound, said procedure comprising:

a step of detecting a pitch of an input sound;

a step of detecting a spectrum envelope of the input sound;

a step of acquiring converting spectrums that is frequency spectrums of a converting sound comprising a plurality of sounds;

a step of generating output spectrums created by imparting the spectrum envelope of the input sound, detected by said step of detecting, to the converting spectrums acquired by said step of acquiring; and a step of synthesizing a sound signal on the basis of the output spectrums generated by said step of generating, wherein said plurality of sounds included in said converting sound have been sounded in parallel from different sound sources, said converting spectrums having a plurality of peaks, a band of each of the peaks being wider than a corresponding band of each peak of spectrums of the input sound, and wherein, as data representative of the converting spectrums acquired by said step of acquiring, said step of acquiring supplies, for each spectrum composing the converting spectrums, unit data composed of data indicative of a frequency and intensity of the spectrum at the frequency, and wherein said step of generating includes:

a pitch conversion step of varying, in accordance with the pitch of the input sound detected by said step of detecting a pitch of an input sound, the frequency indicated by the unit data of each spectrum of the converting spectrums; and an envelope adjustment step of adjusting a spectrum envelope of the converting spectrums, having the frequencies varied by said pitch conversion step, to substantially agree with the spectrum envelope of the input sound detected by said step of detecting a spectrum envelope of the input sound, wherein, for each of the peaks in the converting spectrums, said envelope adjustment step determines an intensity of a frequency in the spectrum envelope of the input sound, said frequency in the spectrum envelope of the input sound corresponding to the frequency of the peak in the converting spectrum, determines a ratio between the determined intensity of the frequency in the spectrum envelope of the input sound and the intensity of a frequency in the converting spectrums as indicated by the unit data, said frequency in the converting spectrum corresponding to the peak in the converting spectrum, and multiplies an intensity of the unit data of each spectrum belonging to the band centered around said peak in the converting spectrums, by the determined ratio, wherein the spectrum envelope of the converting spectrums substantially agree with the spectrum envelope of the input sound.

15. A method for processing an input sound, said method comprising:

a step of detecting a pitch of an input sound;

a step of detecting a spectrum envelope of the input sound;

a step of acquiring converting spectrums that are frequency spectrums of a converting sound;

a step of generating output spectrums created by imparting the spectrum envelope of the input sound, detected by said step of detecting, to the converting spectrums acquired by said step of acquiring; and a step of synthesizing a sound signal on the basis of the output spectrums generated by said step of generating, wherein said step of acquiring selectively acquires either one of first converting spectrums that are frequency spectrums of a first converting sound having a plurality of peaks, or second converting spectrums that are frequency spectrums of a second converting sound having substantially a same pitch as the first converting sound indicated by said first converting spectrums and having a plurality of peaks of a greater bandwidth at each peak than said first converting spectrums, at least said second converting sound comprising a plurality of sounds which have been sounded in parallel from different sound sources, a band of each of the peaks in at least said second converting spectrums being wider than a band of each peak of spectrums of the input sound, and wherein, as data representative of the converting spectrums acquired by said step of acquiring, said step of acquiring supplies, for each spectrum composing the converting spectrums, unit data composed of data indicative of a frequency and intensity of the spectrum at the frequency, and wherein said step of generating includes:

a pitch conversion step of varying, in accordance with the pitch of the input sound detected by said step of detecting a pitch of an input sound, the frequency indicated by the unit data of each spectrum of the converting spectrums supplied by said step of acquiring; and an envelope adjustment step of adjusting a spectrum envelope of the converting spectrums, having the frequencies varied by said pitch conversion step, to substantially agree with the spectrum envelope of the input sound detected by said step of detecting a spectrum envelope of the input sound, wherein, for each of the peaks in the converting spectrums, said envelope adjustment step determines an intensity of a frequency in the spectrum envelope of the input sound, said frequency in the spectrum envelope of the input sound corresponding to the frequency of the peak in the converting spectrum, determines a ratio between the determined intensity of the frequency in the spectrum envelope of the input sound and the intensity of a frequency in the converting spectrums as indicated by the unit data, said frequency in the converting spectrum corresponding to the peak in the converting spectrum, and multiplies an intensity of the unit data of each spectrum belonging to the band centered around said peak in the converting spectrums, by the determined ratio, wherein the spectrum envelope of the converting spectrums substantially agree with the spectrum envelope of the input sound.

16. A computer-readable medium containing a group of instructions for causing a computer to execute a procedure for processing an input sound, said procedure comprising:

a step of detecting a pitch of an input sound;

a step of detecting a spectrum envelope of the input sound;

a step of acquiring converting spectrums that are frequency spectrums of a converting sound;

a step of generating output spectrums created by imparting the spectrum envelope of the input sound, detected by said step of detecting, to the converting spectrums acquired by said step of acquiring; and a step of synthesizing a sound signal on the basis of the output spectrums generated by said step of generating, wherein said step of acquiring selectively acquires either one of first converting spectrums that are frequency spectrums of a first converting sound having a plurality of peaks, or second converting spectrums that are frequency spectrums of a second converting sound having substantially a same pitch as the first converting sound indicated by said first converting spectrums and having a plurality of peaks of a greater bandwidth at each peak than said first converting spectrums, at least said second converting sound comprising a plurality of sounds which have been sounded in parallel from different sound sources, a band of each of the peaks in at least said second converting spectrums being wider than a band of each peak of spectrums of the input sound, and wherein, as data representative of the converting spectrums acquired by said step of acquiring, said step of acquiring supplies, for each spectrum composing the converting spectrums, unit data composed of data indicative of a frequency and intensity of the spectrum at the frequency, and wherein said step of generating includes:

a pitch conversion step of varying, in accordance with the pitch of the input sound detected by said step of detecting a pitch of an input sound, the frequency indicated by the unit data of each spectrum of the converting spectrums supplied by said step of acquiring; and an envelope adjustment step of adjusting a spectrum envelope of the converting spectrums, having the frequencies varied by said pitch conversion step, to substantially agree with the spectrum envelope of the input sound detected by said step of detecting a spectrum envelope of the input sound, wherein, for each of the peaks in the converting spectrums, said envelope adjustment step determines an intensity of a frequency in the spectrum envelope of the input sound, said frequency in the spectrum envelope of the input sound corresponding to the frequency of the peak in the converting spectrum, determines a ratio between the determined intensity of the frequency in the spectrum envelope of the input sound and the intensity of a frequency in the converting spectrum as indicated by the unit data, said frequency in the converting spectrum corresponding to the peak in the converting spectrum, and multiplies an intensity of the unit data of each spectrum belonging to the band centered around said peak in the converting spectrums, by the determined ratio, wherein the spectrum envelope of the converting spectrums substantially agree with the spectrum envelope of the input sound.

* * * * *